US007510367B2

(12) United States Patent
Liang

(10) Patent No.: US 7,510,367 B2
(45) Date of Patent: Mar. 31, 2009

(54) TURBINE AIRFOIL WITH ENDWALL HORSESHOE COOLING SLOT

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 399 days.

(21) Appl. No.: 11/509,229

(22) Filed: Aug. 24, 2006

(65) Prior Publication Data

US 2008/0050223 A1 Feb. 28, 2008

(51) Int. Cl.
*F01D 25/12* (2006.01)

(52) U.S. Cl. ..... 415/115; 415/191

(58) Field of Classification Search ..... 415/115, 415/191; 416/97 R, 189, 193 A
See application file for complete search history.

(56) References Cited

U.S. PATENT DOCUMENTS 4,616,976 A * 10/1986 Lings et al. ..... 416/97 R
5,340,274 A 8/1994 Cunha
5,342,172 A 8/1994 Coudray et al.
5,496,151 A 3/1996 Coudray et al.
5,779,437 A 7/1998 Abdel-Messeh et al.
5,813,836 A 9/1998 Starkweather
5,827,045 A 10/1998 Beeck
6,099,251 A 8/2000 LaFleur
6,164,912 A 12/2000 Tabbita et al.
6,210,112 B1 4/2001 Tabbita et al.
6,241,469 B1 6/2001 Beeck et al.
6,287,075 B1 9/2001 Kercher
6,343,463 B1 * 2/2002 Mei ..... 60/798
6,629,817 B2 10/2003 Shelton et al.
6,837,683 B2 1/2005 Dailey
6,887,033 B1 * 5/2005 Phillips et al. ..... 415/115
6,955,522 B2 10/2005 Cunha et al.
6,997,676 B2 2/2006 Koshoffer

* cited by examiner

*Primary Examiner*—Ninh H Nguyen

(57) ABSTRACT

A turbine airfoil usable in a turbine engine and having at least one cooling system. At least a portion of the cooling system may be positioned in an endwall attached to the turbine airfoil. The endwall may include an endwall horseshoe cooling slot positioned in the first endwall proximate to the leading edge of the airfoil such that one end terminates proximate to the pressure side of the generally elongated hollow airfoil and a second end terminates proximate to the suction side of the generally elongated hollow airfoil. The endwall horseshoe cooling slot may include a plurality of film cooling holes angled to create a film cooling layer to reduce airfoil and endwall temperatures at the intersection between the leading edge of the airfoil and the endwall.

20 Claims, 2 Drawing Sheets

TURBINE AIRFOIL WITH ENDWALL HORSESHOE COOLING SLOT

FIELD OF THE INVENTION

This invention is directed generally to turbine airfoils, and more particularly to hollow turbine airfoils having cooling channels for passing fluids, such as air, to cool the airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine vanes are formed from an elongated portion forming a vane having one end configured to be coupled to a vane carrier and an opposite end configured to be movably coupled to an inner endwall. The vane is ordinarily composed of a leading edge, a trailing edge, a suction side, and a pressure side. The inner aspects of most turbine vanes typically contain an intricate maze of cooling circuits forming a cooling system. The cooling circuits in the vanes receive air from the compressor of the turbine engine and pass the air through the ends of the vane adapted to be coupled to the vane carrier. The cooling circuits often include multiple flow paths that are designed to maintain all aspects of the turbine vane at a relatively uniform temperature. At least some of the air passing through these cooling circuits is exhausted through orifices in the leading edge, trailing edge, suction side, and pressure side of the vane.

Many conventional turbine vanes also include film cooling holes in the endwall of the vane. The film cooling holes provide discrete cooling but suffer from numerous drawbacks. For instance, high film cooling effectiveness is difficult to establish and maintain in a high turbulence environment and large pressure differential region, such as at the intersection between the leading edge and the endwall. In addition, the large pressure gradient that exists at the intersection between the leading edge and the endwall often disrupts the film cooling established by the film cooling holes. Furthermore, the areas between the film cooling orifices and areas immediately downstream from the film cooling orifices are typically not in contact with the cooling fluids and therefore are not cooled by the cooling fluids. Consequently, these areas are more susceptible to thermal degradation and over temperatures. Thus, a need exists for a turbine vane having increased cooling efficiency for dissipating heat at the intersection of the leading edge of the turbine blade and the endwall.

SUMMARY OF THE INVENTION

This invention relates to a turbine vane having an internal cooling system for removing heat from the turbine airfoil. The turbine airfoil cooling system may be formed from a cooling system having a plurality of cooling channels. For instance, the turbine airfoil cooling system may include an endwall horseshoe cooling slot positioned in an endwall attached to a generally elongated airfoil that forms a portion of the turbine airfoil. The endwall horseshoe cooling slot may be positioned proximate to an intersection between the endwall and the generally elongated airfoil such that a portion of the endwall horseshoe cooling slot extends around a leading edge on a pressure side of the generally elongated airfoil and a portion of the endwall horseshoe cooling slot extends around the leading edge on a suction side of the generally elongated airfoil. The endwall horseshoe cooling slot may also include a plurality of film cooling orifices to enable cooling fluids from internal aspects of the turbine airfoil cooling system to be exhausted from the turbine airfoil and create a film cooling layer in the endwall horseshoe cooling slot at the intersection between the leading edge and the endwall. The endwall horseshoe cooling slot may be positioned in the outer endwall, the inner endwall, or both.

The turbine airfoil may be formed from a generally elongated hollow airfoil formed from an outer wall, and having a leading edge, a trailing edge, a pressure side, a suction side, a first endwall at a first end, a second endwall at a second end opposite the first end. The endwall horseshoe cooling slot may be positioned in the first endwall proximate to the leading edge of the airfoil such that one end terminates proximate to the pressure side of the generally elongated hollow airfoil, and a second end terminates proximate to the suction side of the generally elongated hollow airfoil. The endwall horseshoe cooling slot may have an outer surface positioned inward of an outer surface of the first endwall.

The endwall horseshoe cooling slot may include two or more radii of curvature. In particular, the outer surface of the endwall horseshoe cooling slot may be curved inwardly into the first endwall from a leading edge to a trailing edge of the endwall horseshoe cooling slot thereby forming a chordwise curved portion. In addition, the outer surface of the endwall horseshoe cooling slot may be curved inwardly into the first endwall from a pressure side edge to a suction side edge of the endwall horseshoe cooling slot thereby forming a cross airfoil curved portion. The radius of curvature of the chordwise curved portion may be equal to or different than the radius of curvature of the cross airfoil curved portion.

In one embodiment, a leading edge of the endwall horseshoe cooling slot may be generally flush with the outer surface of the first endwall, a trailing edge of the endwall horseshoe cooling slot may be generally flush with the leading edge of the generally elongated airfoil, and the outer surface of the endwall horseshoe cooling slot may be curved inwardly into the first endwall from the leading edge to the trailing edge of the endwall horseshoe cooling slot thereby forming the chordwise curved portion. A transition section may be positioned at the leading edge of the endwall horseshoe cooling slot and may have a convex outer surface providing a transition between the outer surface of the first endwall and the chordwise curved portion. In addition, a pressure side edge of the endwall horseshoe cooling slot may be generally flush with the outer surface of the first endwall, a suction side edge of the endwall horseshoe cooling slot may be generally flush with the outer surface of the first endwall, and the outer surface of the endwall horseshoe cooling slot may be curved inwardly into the first endwall from the suction side edge to the pressure side edge of the endwall horseshoe cooling slot thereby forming the cross airfoil curved portion. A pressure side transition section may be positioned at the pressure side edge of the endwall horseshoe cooling slot and may have a convex outer surface providing a transition between the outer surface of the first endwall and the cross airfoil curved portion. A suction side transition section may also be positioned at the suction side edge of the endwall horseshoe cooling slot and may have a convex outer surface providing a transition between the outer surface of the first endwall and the cross airfoil curved portion.

A plurality of film cooling orifices may be positioned in the endwall horseshoe cooling slot. The film cooling orifices positioned toward the pressure side of the generally elongated airfoil from a stagnation point may be angled away from the stagnation point toward a pressure side edge of the endwall horseshoe cooling slot. The film cooling orifices positioned toward the suction side of the generally elongated airfoil from the stagnation point may be angled away from the stagnation point toward a suction side edge of the endwall horseshoe cooling slot. A plurality of leading edge film cooling orifices may be positioned in the leading edge of the generally elongated airfoil and angled toward the endwall horseshoe cooling slot.

An advantage of this invention is that the endwall horseshoe cooling slot forms a depression in the endwall enabling cooling fluids exhausted from the film cooling orifices in the endwall horseshoe cooling slot to collect and form a film cooling layer in the endwall horseshoe cooling slot at the intersection of the leading edge and the endwall where, without the endwall horseshoe cooling slot, over temperatures where previously encountered in conventional designs.

Another advantage of this invention is that the endwall horseshoe cooling slot provides improved cooling along the endwall horseshoe cooling slot and improved film formation relative to the conventional discrete film cooling holes.

Yet another advantage is that film cooling holes on the end wall of the airfoil leading edge provides convective film cooling for the leading edge as well as reduces the down draft hot gas air for the intersection of the leading edge and the endwall.

Another advantage of this invention is that cooling air that collects in the endwall horseshoe cooling slot dilutes the hot gas air and provides film cooling to downstream components.

Still another advantage of this invention is that the endwall horseshoe cooling slot increases the uniformity of the film cooling and insulates the endwall from the passing hot gases by establishing a durable cooling fluid film at the horseshoe vortex region.

Another advantage of this invention is that the endwall horseshoe cooling slot minimizes cooling loss or degradation of the film and therefore provides more effective film cooling for film development and maintenance.

Yet another advantage of this invention is that the endwall horseshoe cooling slot creates additional local volume for the expansion of the down draft hot core gases and slows the secondary flow and reduces the pressure gradient, thereby weakening the horseshoe vortex and minimizing the high heat transfer coefficients created due to the horseshoe vortex at the leading edge.

Another advantage of this invention is that the endwall horseshoe cooling slot extends the cooling air continuously along the interface of the airfoil leading edge, thereby minimizing thermally induced stress created in conventional configurations with discrete film cooling holes.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
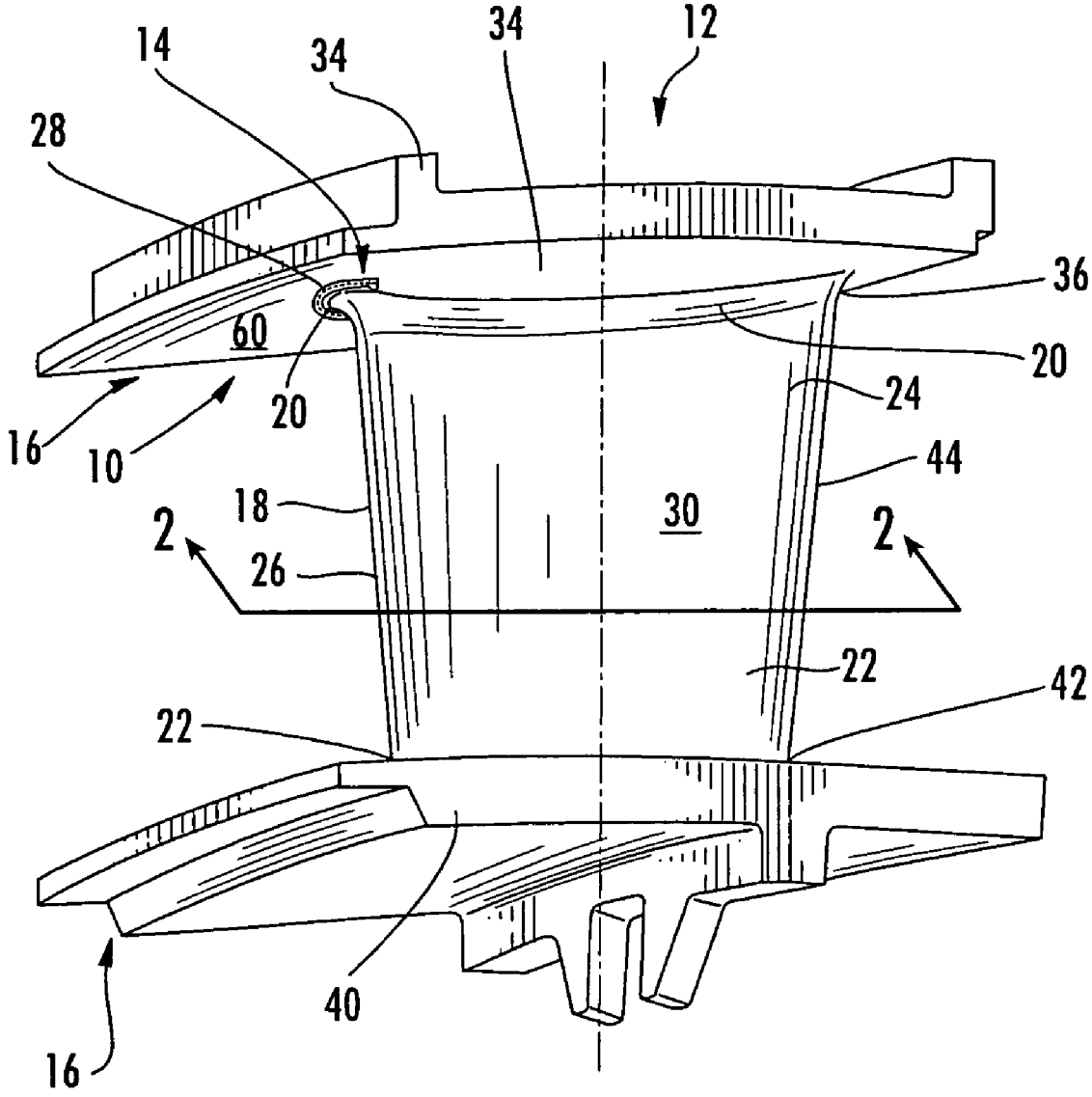
FIG. 1 is a perspective view of a turbine airfoil having features according to the instant invention.

As shown in FIGS. 1-4, this invention is directed to a turbine airfoil cooling system 10 configured to cool internal and external aspects of a turbine airfoil 12 usable in a turbine engine. In at least one embodiment, the turbine airfoil cooling system 10 may be configured to be included within a stationary turbine vane, as shown in FIGS. 1-4. The turbine airfoil cooling system 10 may include one or more endwall horseshoe cooling slots 14 positioned in an endwall 16 attached to a generally elongated airfoil 18 that forms a portion of the turbine airfoil 12. The endwall horseshoe cooling slot 14 may be positioned proximate to an intersection 20 between the endwall 16 and the generally elongated airfoil 18 such that a portion of the endwall horseshoe cooling slot 14 extends around a leading edge 22 on a pressure side 24 of the generally elongated airfoil 18 and a portion of the endwall horseshoe cooling slot 14 extends around the leading edge 22 on a suction side 26 of the generally elongated airfoil 18. The endwall horseshoe cooling slot 14 may include two or more radii of curvature. The endwall horseshoe cooling slot 14 may also include a plurality of film cooling orifices 28 to enable cooling fluids from internal aspects of the turbine airfoil cooling system 10 to be exhausted from the turbine airfoil 12 and create a film cooling layer in the endwall horseshoe cooling slot 14 at the intersection 20 between the leading edge 22 and the endwall 16.

As shown in FIG. 1, the turbine airfoil 12 may be formed from the generally elongated hollow airfoil 18 having an outer surface 32 adapted for use, for example, in an axial flow turbine engine. Outer surface 32 may have a generally concave shaped portion forming the pressure side 24 and a generally convex shaped portion forming the suction side 26. The turbine vane 12 may also include an outer endwall 34 at a first end 36 adapted to be coupled to a hook attachment and may include an inner endwall 40 at a second end 42. The airfoil 18 may also include the leading edge 22 and a trailing edge 44. For clarity, the following description describes the endwall horseshoe cooling slot 14 positioned in the outer endwall 34. However, one or more endwall horseshoe cooling slots 14 may also be positioned in the inner endwall 40 as well. All components of the endwall horseshoe cooling slot 14 in the outer endwall 34 may be positioned in the inner endwall 40.

As shown in FIGS. 1-4, the endwall horseshoe cooling slot 14 may extend around the leading edge 22 on the pressure side 24 of the generally elongated airfoil 18 and a portion of the endwall horseshoe cooling slot 14 may extend around the leading edge 22 on the suction side 26 of the generally elongated airfoil 18. The endwall horseshoe cooling slot 14 is constructed with the airfoil leading edge diameter extended inward of the outer surface 60 of the endwall 16. The depth of the endwall horseshoe cooling slot 14 is gradually reduced as the slot 16 wraps around the leading edge 22 in the chordwise direction. The size of the endwall horseshoe cooling slot 14 is dictated by the size of the leading edge 22 of the generally elongated airfoil 18.

Figure 2:
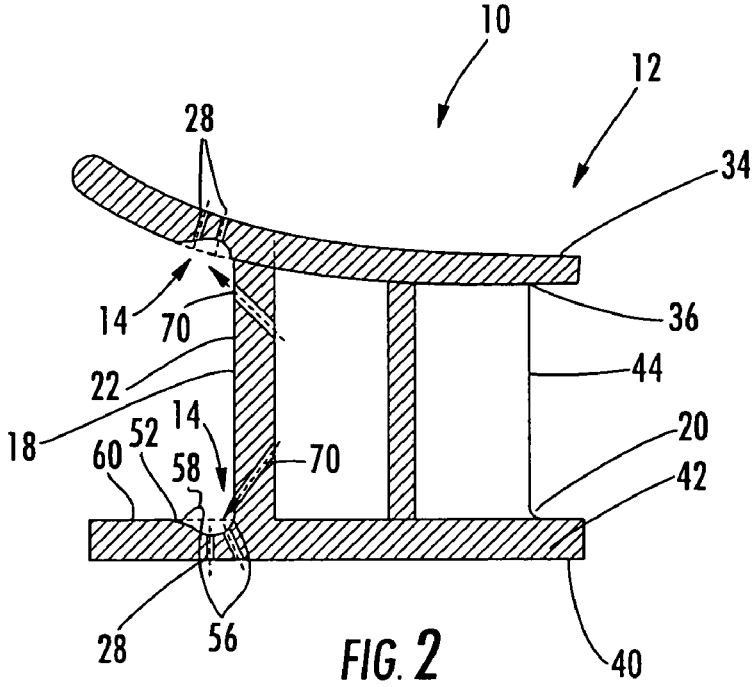
FIG. 2 is a cross-sectional view of the turbine airfoil shown in FIG. 1 taken along line 2-2.
Figure 4:
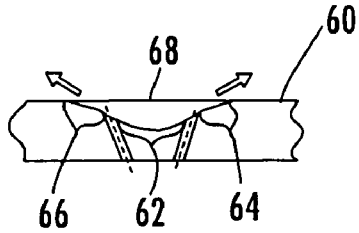
FIG. 4 is a cross-sectional view of the endwall horseshoe cooling slot in the turbine airfoil shown in FIG. 3 taken along line 4-4 in FIG. 3.

In one embodiment, a pressure side edge 46 of the endwall horseshoe cooling slot 14 may be positioned proximate to the pressure side 24 and a suction side edge 48 of the endwall horseshoe cooling slot 14 may be positioned proximate to the suction side 26. As shown in FIGS. 2 and 4, the endwall cooling slot 14 may include two radii of curvature. In particular, as shown in FIG. 2, the outer surface 50 of the endwall horseshoe cooling slot 14 may be curved inwardly into the first endwall 34 from a leading edge 52 of the endwall horseshoe cooling slot 14 to a trailing edge 54 of the endwall horseshoe cooling slot 14 thereby forming a chordwise curved portion 56. A second curvature, as shown in FIG. 4, may be formed in the endwall horseshoe cooling slot 14, in which the endwall horseshoe cooling slot 14 may also be curved inwardly into the endwall 34 from the pressure side edge 46 to a suction side edge 48 of the endwall horseshoe cooling slot 14 thereby forming a cross airfoil curved portion 62.

In one embodiment, as shown in FIG. 2, the leading edge 52 of the endwall horseshoe cooling slot 14 may be generally flush with the outer surface 60 of the first endwall 34. The trailing edge 54 of the endwall horseshoe cooling slot 14 may be generally flush with the leading edge 22 of the generally elongated airfoil 18. The outer surface 50 may also include a transition section 58 at the leading edge 52 of the endwall horseshoe cooling slot 14. The transition section 58 may have a convex outer surface providing a transition between an outer surface 60 of the first endwall 34 and the chordwise curved portion 56. The trailing edge 54 of the endwall horseshoe cooling slot 14 may curve from the chordwise curved portion 56 into the leading edge 22 of the generally elongated airfoil 18.

As shown in FIG. 4, the endwall horseshoe cooling slot 14 may also be curved inwardly into the endwall 34 from the pressure side edge 46 to a suction side edge 48 of the endwall horseshoe cooling slot 14 thereby forming a cross airfoil curved portion 62. In one embodiment, the pressure side edge 46 of the endwall horseshoe cooling slot 14 may be generally flush with the outer surface 60 of the first endwall 34. A suction side edge 48 of the endwall horseshoe cooling slot 14 may be generally flush with the outer surface 60 of the first endwall 34.

As shown in FIG. 4, the endwall horseshoe cooling slot 14 may also include a pressure side transition section 64 at the pressure side edge 46 of the endwall horseshoe cooling slot 14 and may have a convex outer surface 50 providing a transition between the outer surface 60 of the first endwall 34 and the cross airfoil curved portion 62. The endwall horseshoe cooling slot 14 may also include a suction side transition section 66 at the suction side edge 48 of the endwall horseshoe cooling slot 14 and may have a convex outer surface 50 providing a transition between the outer surface 60 of the first endwall 34 and the cross airfoil curved portion 64.

In one embodiment, as shown in FIG. 4, the pressure side edge 46 of the endwall horseshoe cooling slot 14 may be generally flush with the outer surface 60 of the first endwall 34. The suction side edge 48 of the endwall horseshoe cooling slot 14 may be generally flush with the outer surface 60 of the first endwall 34. The outer surface 50 of the endwall horseshoe cooling slot 14 may be curved inwardly into the first endwall 14 from the suction side edge 48 to the pressure side edge 46 of the endwall horseshoe cooling slot 14, thereby forming the cross airfoil curved portion 62. A pressure side transition section 64 may be positioned at the pressure side edge 46 of the endwall horseshoe cooling slot 14 and may have a convex outer surface providing a transition between the outer surface 60 of the first endwall 34 and the cross airfoil curved portion 62. A suction side transition section 66 may be positioned at the suction side edge 48 of the endwall horseshoe cooling slot 14 and may have a convex outer surface providing a transition between the outer surface 60 of the first endwall 34 and the cross airfoil curved portion 62.

The cooling system 10 may include a plurality of film cooling orifices 28 positioned in the endwall horseshoe cooling slot 14. The film cooling orifices 28 positioned toward the pressure side 24 of the generally elongated airfoil 18 from a stagnation point 68 may be angled away from the stagnation point 68 toward a pressure side edge 46 of the endwall horseshoe cooling slot 14. The film cooling orifices 28 positioned toward the suction side 26 of the generally elongated airfoil 18 from the stagnation point 68 may be angled away from the stagnation point 68 toward a suction side edge 26 of the endwall horseshoe cooling slot 14. As shown in FIG. 4, the film cooling orifices 28 may be aligned into rows extending around the pressure and suction sides 24, 26. The film cooling orifices 28 may extend through an outer wall forming the elongated airfoil 18 and be in communication with internal cooling channels of the cooling system 10.

Figure 3:
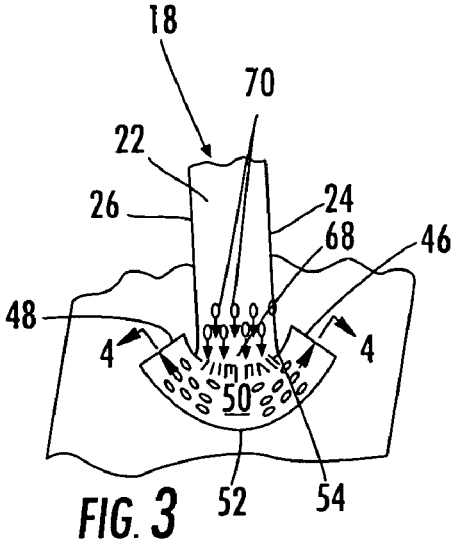
FIG. 3 is a detailed view of the intersection between the leading edge of the turbine airfoil and an endwall taken along line 3-3 in FIG. 1.

As shown in FIG. 3, the cooling system 10 may also include a plurality of leading edge film cooling orifices 70 positioned in the leading edge 22 of the generally elongated airfoil 18 and angled toward the endwall horseshoe cooling slot 14. The plurality of leading edge film cooling orifices 70 may extend through an outer wall forming the elongated airfoil 18 and be in communication with internal cooling channels.

During use, the cooling fluids may be exhausted through the leading edge film cooling orifices 70 and the film cooling orifices 28 in the endwall horseshoe cooling slot 14. Because the film cooling orifices 28 are angled in a downstream direction of the hot gas flow and the endwall horseshoe cooling slot 14 is positioned inwardly in the endwall 16, the cooling fluids exhausted from the film cooling orifices 28 build up and slow down secondary hot gas flow proximate to the outer surface 60 of the endwall 16. As such, cooling fluids may be retained in the endwall horseshoe cooling slot 14. Spent cooling fluids may be passed out of the endwall horseshoe cooling slot 14 onto the outer surface 60 of the endwall 16 to provide additional film cooling for the downstream aspects of the turbine airfoil 12. Cooling fluids flowing from the leading edge film cooling orifices 70 form a film sub-layer for the leading edge 22 from the downward draft of the hot gas stream.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated hollow airfoil formed from an outer wall, and having a leading edge, a trailing edge, a pressure side, a suction side, a first endwall at a first end, a second endwall at a second end opposite the first end;

at least one endwall horseshoe cooling slot positioned in the first endwall proximate to the leading edge of the airfoil such that one end terminates proximate to the pressure side of the generally elongated hollow airfoil and a second end terminates proximate to the suction side of the generally elongated hollow airfoil; and wherein the at least one endwall horseshoe cooling slot has an outer surface positioned inward of an outer surface of the first endwall.

2. The turbine airfoil of claim 1, wherein the outer surface of the at least one endwall horseshoe cooling slot is curved inwardly into the first endwall from a leading edge to a trailing edge of the at least one endwall horseshoe cooling slot thereby forming a chordwise curved portion.

3. The turbine airfoil of claim 1, wherein a leading edge of the at least one endwall horseshoe cooling slot is generally flush with the outer surface of the first endwall, a trailing edge of the at least one endwall horseshoe cooling slot is generally flush with the leading edge of the generally elongated airfoil, and the outer surface of the at least one endwall horseshoe cooling slot is curved inwardly into the first endwall from the leading edge to the trailing edge of the at least one endwall horseshoe cooling slot thereby forming the chordwise curved portion.

4. The turbine airfoil of claim 3, further comprising a transition section at the leading edge of the at least one endwall horseshoe cooling slot and having a convex outer surface providing a transition between the outer surface of the first endwall and the chordwise curved portion.

5. The turbine airfoil of claim 1, wherein the outer surface of the at least one endwall horseshoe cooling slot is curved inwardly into the first endwall from a pressure side edge to a suction side edge of the at least one endwall horseshoe cooling slot thereby forming a cross airfoil curved portion.

6. The turbine airfoil of claim 5, wherein a pressure side edge of the at least one endwall horseshoe cooling slot is generally flush with the outer surface of the first endwall, a suction side edge of the at least one endwall horseshoe cooling slot is generally flush with the outer surface of the first endwall, and the outer surface of the at least one endwall horseshoe cooling slot is curved inwardly into the first endwall from the suction side edge to the pressure side edge of the at least one endwall horseshoe cooling slot thereby forming the cross airfoil curved portion.

7. The turbine airfoil of claim 6, further comprising a pressure side transition section at the pressure side edge of the at least one endwall horseshoe cooling slot and having a convex outer surface providing a transition between the outer surface of the first endwall and the cross airfoil curved portion and further comprising a suction side transition section at the suction side edge of the at least one endwall horseshoe cooling slot and having a convex outer surface providing a transition between the outer surface of the first endwall and the cross airfoil curved portion.

8. The turbine airfoil of claim 1, further comprising a plurality of film cooling orifices positioned in the at least one endwall horseshoe cooling slot, wherein the film cooling orifices positioned toward the pressure side of the generally elongated airfoil from a stagnation point are angled away from the stagnation point toward a pressure side edge of the at least one endwall horseshoe cooling slot and wherein the film cooling orifices positioned toward the suction side of the generally elongated airfoil from the stagnation point are angled away from the stagnation point toward a suction side edge of the at least one endwall horseshoe cooling slot.

9. The turbine airfoil of claim 1, further comprising a plurality of leading edge film cooling orifices positioned in the leading edge of the generally elongated airfoil and angled toward the at least one endwall horseshoe cooling slot.

10. The turbine airfoil of claim 1, further comprising at least one endwall horseshoe cooling slot positioned in the second endwall proximate to the leading edge of the airfoil such that one end terminates proximate to the pressure side of the generally elongated hollow airfoil and a second end terminates proximate to the suction side of the generally elongated hollow airfoil, and wherein the at least one endwall horseshoe cooling slot has an outer surface positioned inward of an outer surface of the second endwall.

11. The turbine airfoil of claim 10, wherein the outer surface of the at least one endwall horseshoe cooling slot in the second endwall is curved inwardly into the second endwall from a leading edge to a trailing edge of the at least one endwall horseshoe cooling slot in the second endwall thereby forming a chordwise curved portion, and wherein the outer surface of the at least one endwall horseshoe cooling slot in the second endwall is curved inwardly into the first endwall from a pressure side edge to a suction side edge of the at least one endwall horseshoe cooling slot in the second endwall thereby forming a cross airfoil curved portion.

12. The turbine airfoil of claim 11, wherein a leading edge of the at least one endwall horseshoe cooling slot is generally flush with the outer surface of the second endwall, a trailing edge of the at least one endwall horseshoe cooling slot is generally flush with the leading edge of the generally elongated airfoil, and the outer surface of the at least one endwall horseshoe cooling slot is curved inwardly into the first endwall from the leading edge to the trailing edge of the at least one endwall horseshoe cooling slot thereby forming the chordwise curved portion.

13. The turbine airfoil of claim 12, further comprising a plurality of film cooling orifices positioned in the at least one endwall horseshoe cooling slot in the second endwall, wherein the film cooling orifices positioned toward the pressure side of the generally elongated airfoil from a stagnation point are angled away from the stagnation point toward a pressure side edge of the at least one endwall horseshoe cooling slot in the second endwall and wherein the film cooling orifices positioned toward the suction side of the generally elongated airfoil from the stagnation point are angled away from the stagnation point toward a suction side edge of the at least one endwall horseshoe cooling slot in the second endwall, and further comprising a plurality of leading edge film cooling orifices positioned in the leading edge of the generally elongated airfoil and angled toward the at least one endwall horseshoe cooling slot in the second endwall.

14. A turbine airfoil, comprising:

a generally elongated hollow airfoil formed from an outer wall, and having a leading edge, a trailing edge, a pressure side, a suction side, a first endwall at a first end, a second endwall at a second end opposite the first end;

at least one endwall horseshoe cooling slot positioned in the first endwall proximate to the leading edge of the airfoil such that one end terminates proximate to the pressure side of the generally elongated hollow airfoil and a second end terminates proximate to the suction side of the generally elongated hollow airfoil;

wherein the at least one endwall horseshoe cooling slot has an outer surface positioned inward of an outer surface of the first endwall;

wherein the outer surface of the at least one endwall horseshoe cooling slot has at least two radii of curvature such that the outer surface of the at least one endwall horseshoe cooling slot is curved inwardly into the first endwall from a leading edge to a trailing edge of the at least one endwall horseshoe cooling slot thereby forming a chordwise curved portion and the outer surface of the at least one endwall horseshoe cooling slot is curved inwardly into the first endwall from a pressure side edge to a suction side edge of the at least one endwall horseshoe cooling slot thereby forming a cross airfoil curved portion.

15. The turbine airfoil of claim 14, wherein a leading edge of the at least one endwall horseshoe cooling slot is generally flush with the outer surface of the first endwall, a trailing edge of the at least one endwall horseshoe cooling slot is generally flush with the leading edge of the generally elongated airfoil, and the outer surface of the at least one endwall horseshoe cooling slot is curved inwardly into the first endwall from the leading edge to the trailing edge of the at least one endwall horseshoe cooling slot thereby forming the chordwise curved portion.

16. The turbine airfoil of claim 15, further comprising a transition section at the leading edge of the at least one endwall horseshoe cooling slot and having a convex outer surface providing a transition between the outer surface of the first endwall and the chordwise curved portion.

17. The turbine airfoil of claim 16, wherein a pressure side edge of the at least one endwall horseshoe cooling slot is generally flush with the outer surface of the first endwall, a suction side edge of the at least one endwall horseshoe cooling slot is generally flush with the outer surface of the first endwall, and the outer surface of the at least one endwall horseshoe cooling slot is curved inwardly into the first endwall from the suction side edge to the pressure side edge of the at least one endwall horseshoe cooling slot thereby forming the cross airfoil curved portion.

18. The turbine airfoil of claim 17, further comprising a pressure side transition section at the pressure side edge of the at least one endwall horseshoe cooling slot and having a convex outer surface providing a transition between the outer surface of the first endwall and the cross airfoil curved portion and further comprising a suction side transition section at the suction side edge of the at least one endwall horseshoe cooling slot and having a convex outer surface providing a transition between the outer surface of the first endwall and the cross airfoil curved portion.

19. The turbine airfoil of claim 14, further comprising a plurality of film cooling orifices positioned in the at least one endwall horseshoe cooling slot, wherein the film cooling orifices positioned toward the pressure side of the generally elongated airfoil from a stagnation point are angled away from the stagnation point toward a pressure side edge of the at least one endwall horseshoe cooling slot and wherein the film cooling orifices positioned toward the suction side of the generally elongated airfoil from the stagnation point are angled away from the stagnation point toward a suction side edge of the at least one endwall horseshoe cooling slot.

20. The turbine airfoil of claim 19, further comprising a plurality of leading edge film cooling orifices positioned in the leading edge of the generally elongated airfoil and angled toward the at least one endwall horseshoe cooling slot.

* * * * *